US010290970B1

(12) United States Patent
Weber, Jr. et al.

(10) Patent No.: US 10,290,970 B1
(45) Date of Patent: May 14, 2019

(54) CONNECTOR WITH STRAIN RELIEF DEVICE

(71) Applicant: Delphi Technologies, LLC, Troy, MI (US)

(72) Inventors: Wesley W. Weber, Jr., Metamora, MI (US); Ronald A. Puhl, Poland, OH (US)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 15/891,825

(22) Filed: Feb. 8, 2018

(51) Int. Cl.
*H01R 13/58* (2006.01)
*H01R 13/506* (2006.01)

(52) U.S. Cl.
CPC ..... *H01R 13/5829* (2013.01); *H01R 13/506* (2013.01)

(58) Field of Classification Search
CPC ..... H01R 13/5804; H01R 13/5808; H01R 13/5812; H01R 13/5816; H01R 13/5829
USPC ..... 439/470–473
See application file for complete search history.

(56) References Cited

U.S. PATENT DOCUMENTS 3,711,632 A 1/1973 Ghirardi
5,839,911 A * 11/1998 Dinkel ..... H01R 13/582 439/470
5,908,327 A * 6/1999 Tsuji ..... H01R 13/506 439/470
5,921,805 A * 7/1999 Tabata ..... H01R 13/5804 439/457
5,967,830 A * 10/1999 Tsuji ..... H01R 13/506 439/467
6,019,638 A * 2/2000 Saka ..... H01R 13/7197 439/470
6,153,827 A * 11/2000 Taranto ..... F16C 1/26 174/135
6,196,865 B1 * 3/2001 Ruffel ..... H01R 13/56 439/470
6,203,362 B1 * 3/2001 Tsuji ..... H01R 13/506 439/470
6,234,823 B1 * 5/2001 Fuess ..... H01R 13/5816 439/346
6,454,594 B2 * 9/2002 Sawayanagi ..... H01R 12/68 439/467
7,500,643 B2 3/2009 Lone et al.
(Continued)

FOREIGN PATENT DOCUMENTS

EP 2105996 A1 9/2009

*Primary Examiner* — Ross N Gushi
(74) *Attorney, Agent, or Firm* — Robert J. Myers

(57) ABSTRACT

A connector assembly includes a connector body, a flexible elongate conductor, such as an electrical cable, that is terminated within the connector body, and a strain relief device attached to the connector body. The strain relief device has a clamping collar configured to surround a portion of the conductor. The clamping collar comprises a first half ring and a second half ring, each having first ends that are separable to allow the strain relief device to be fitted over the conductor. The first and second half rings each have second ends joined by a hinge feature. The clamping collar further includes means for limiting rotation of the first and second half rings about the hinge, such as a first arm extending from the first half ring and a second arm extending from the second half ring. The first arm is configured to contact the second arm, thereby limiting the rotation.

16 Claims, 9 Drawing Sheets

(56) References Cited

U.S. PATENT DOCUMENTS 9,698,522 B2 7/2017 Markefka
10,020,599 B1 * 7/2018 Lepez ..... H01R 4/2458
2003/0199193 A1 * 10/2003 Amemiya ..... H01R 13/5812 439/470
2003/0224652 A1 * 12/2003 Chen ..... H01R 9/2416 439/494
2004/0102082 A1 * 5/2004 Tsuji ..... H01R 13/562 439/470
2005/0003698 A1 * 1/2005 Hata ..... H02G 3/0691 439/470
2005/0003699 A1 * 1/2005 Fukui ..... H01R 13/562 439/473
2007/0281539 A1 * 12/2007 Bigotto ..... H01R 13/5812 439/469
2008/0032544 A1 * 2/2008 Tsuji ..... H01R 13/506 439/470
2008/0096417 A1 * 4/2008 Boeck ..... H01R 13/5804 439/445
2008/0188120 A1 * 8/2008 Tsuji ..... H01R 13/5841 439/470
2008/0261425 A1 * 10/2008 Nakamura ..... H01R 13/5812 439/188
2008/0318460 A1 * 12/2008 Hsieh ..... H01R 13/426 439/345
2009/0035987 A1 * 2/2009 Daly ..... H01R 4/36 439/502
2011/0237117 A1 * 9/2011 Lim ..... H01R 13/5812 439/470
2011/0315442 A1 * 12/2011 Nolting ..... H01R 13/506 174/652
2012/0236479 A1 * 9/2012 Tamai ..... B62D 5/0406 361/679.01
2012/0276762 A1 * 11/2012 Hohner ..... H01R 9/0527 439/98
2013/0102185 A1 * 4/2013 Mulfinger ..... H01R 13/516 439/460
2013/0316574 A1 * 11/2013 Peuchet ..... H01R 13/5812 439/574
2014/0069904 A1 * 3/2014 Sammons ..... H01R 13/502 219/136
2015/0037988 A1 * 2/2015 Torii ..... H01R 13/506 439/136
2015/0083455 A1 * 3/2015 Keith ..... H01R 13/5816 174/73.1
2016/0181725 A1 * 6/2016 Kao ..... H01R 13/5804 439/460
2016/0181755 A1 * 6/2016 Kao ..... H01R 13/5845 264/272.14
2016/0204543 A1 * 7/2016 Kanda ..... H01R 13/5812 439/470
2016/0240954 A1 * 8/2016 Grudzewski ..... H01R 13/502
2016/0336682 A1 * 11/2016 Markefka ..... H01R 13/5804
2017/0085067 A1 * 3/2017 Sugimoto ..... H01R 13/5812
2017/0141512 A1 * 5/2017 Drescher ..... H02G 3/065
2017/0148542 A1 * 5/2017 Maeda ..... H01B 7/0045
2017/0149170 A1 * 5/2017 Tait ..... H01R 13/506
2017/0155210 A1 * 6/2017 Ludwig ..... H01R 13/5812
2017/0331222 A1 * 11/2017 Pham ..... H01R 13/5812

* cited by examiner

CONNECTOR WITH STRAIN RELIEF DEVICE

TECHNICAL FIELD OF THE INVENTION

The invention generally relates to connectors, particularly a connector having a strain relief device.

BRIEF DESCRIPTION OF THE SEVERAL VIEWS OF THE DRAWING

The present invention will now be described, by way of example with reference to the accompanying drawings, in which.

Similar elements of the various embodiments share the last two digits of the reference numbers recited in the above listed figures and the following detailed description of the invention.

DETAILED DESCRIPTION OF THE INVENTION

Presented herein is a connector system that includes a strain relief device that is configured to reduce the strain applied to an elongate conductor in a region of the cable where it exits a connector body. The strain relief device includes two half ring portions that can be partially separated to that the strain relief device may be laterally attached to the conductor rather an longitudinal slid over an end of the conductor. The two half rings are joined by a hinge mechanism and the strain relief device further includes a rotation limiting feature that limits the rotation of the half rings about the hinge feature.

Figure 1:
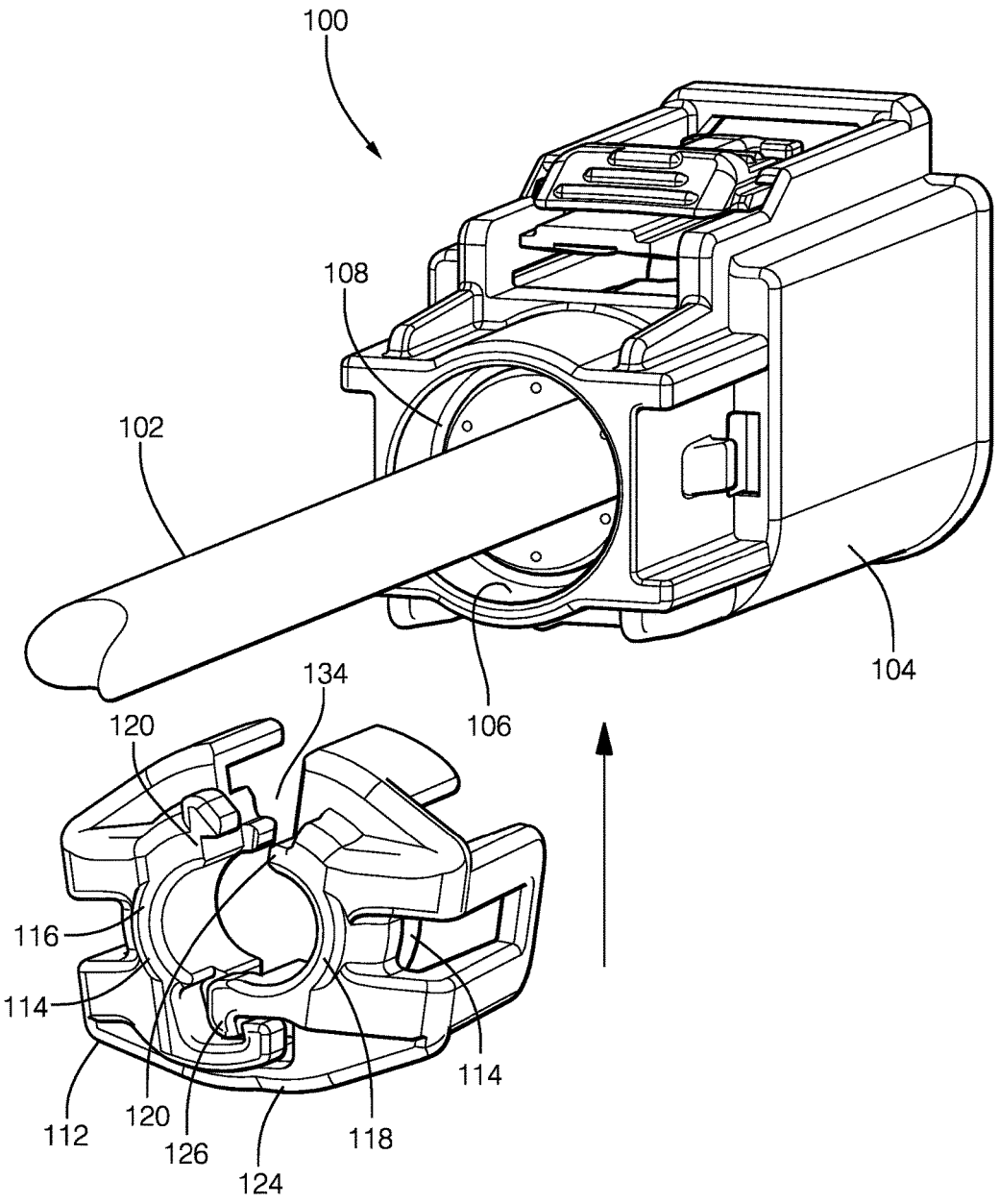
FIG. 1 is an exploded perspective view of a connector assembly according to one embodiment.

FIGS. 1 through 8 illustrate a non-limiting example of a first embodiment of the invention. A connector assembly, hereinafter referred to as the assembly 100 is shown in FIG. 1. The assembly 100 includes an elongate conductor, in this particular example an insulated wire electrical cable 102 that is terminated by a conductive connector terminal (not shown). The system also includes a connector body 104 defining a cavity 106 in which the terminal is secured. The connector body 104 is formed of a polymeric material, such as such as polybutylene terephthalate (PBT), polypropylene (PP), or polyamine (PA) commonly referred to be the tradename NYLON. A compliant seal 108 formed on an elastomeric material, such as a silicone rubber, surrounds the cable and is disposed within the cavity 106. The seal 108 is in compressive contact with the cable and the inner wall 110 of the cavity 106. The seal 108 is configured to inhibit entry of contaminants, such as water or dust, into the cavity 106 that could damage the terminal.

Figure 4:
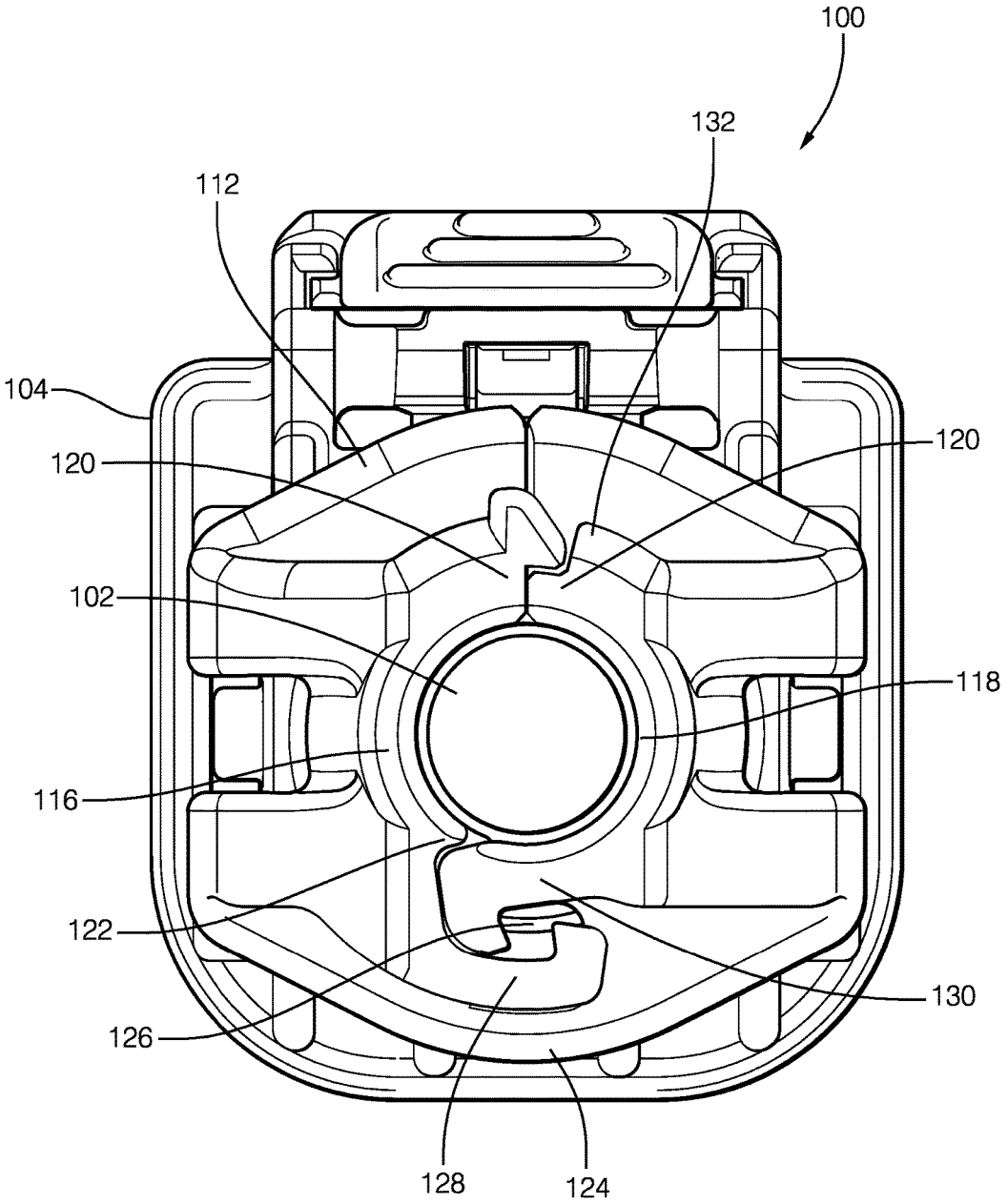
FIG. 4 is an rear end view of the connector system of FIG. 3 according to one embodiment.
Figure 5:
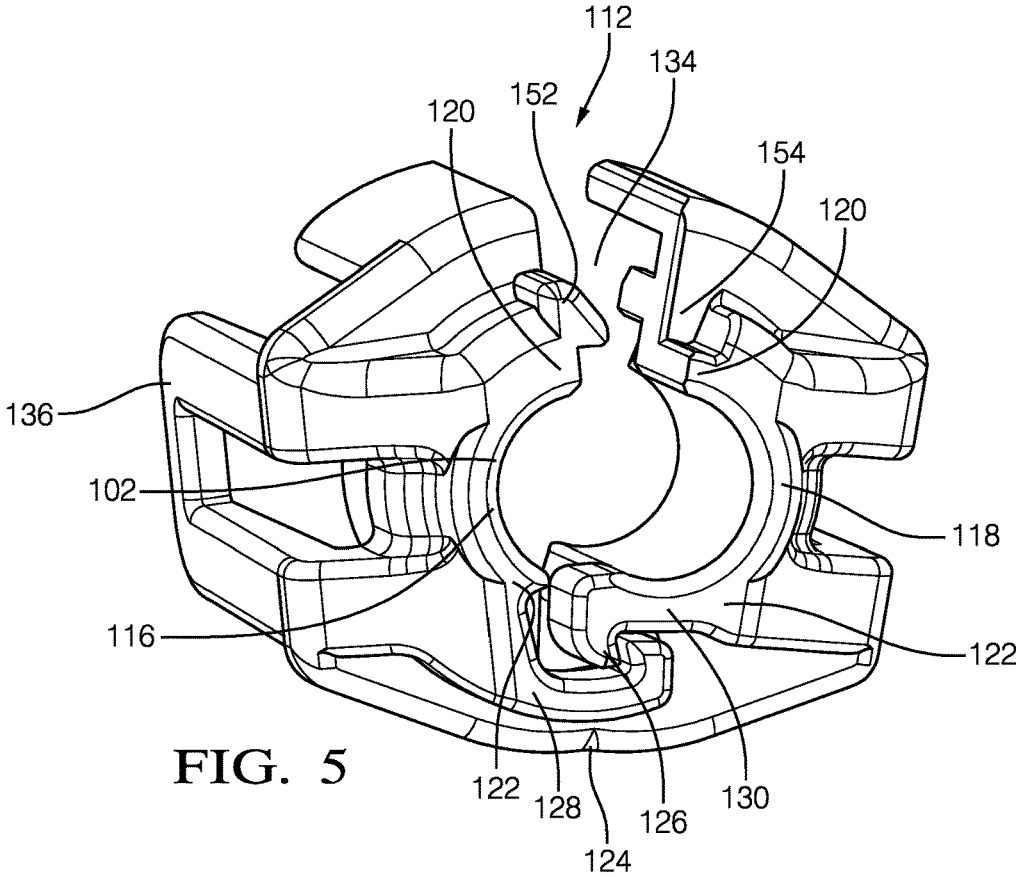
FIG. 5 is a rear end view of the strain relief device shown in FIGS. 1-4 in an open configuration according to one embodiment.
Figure 6:
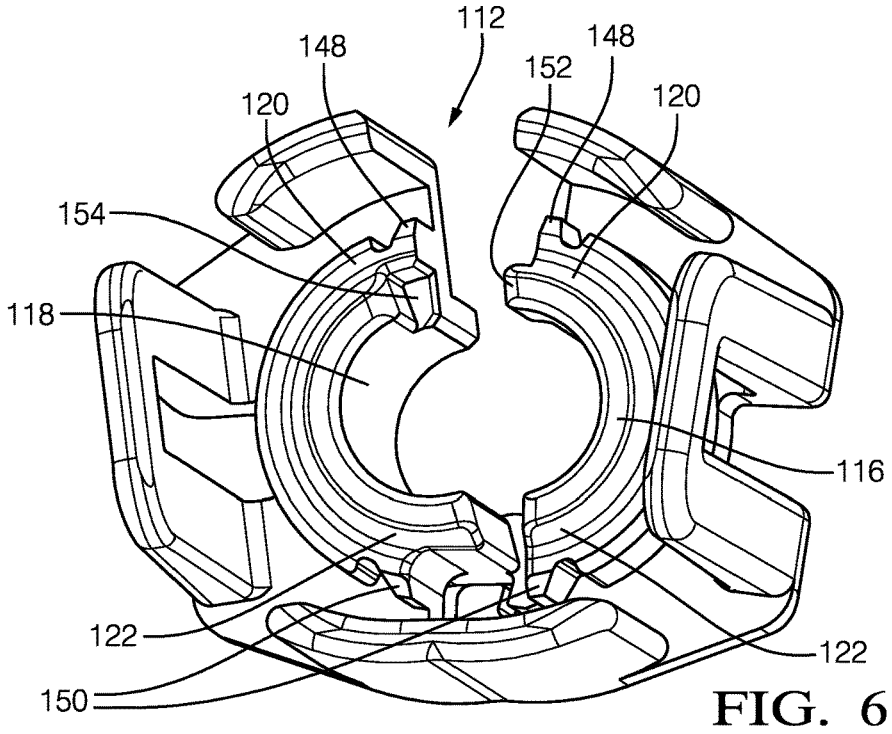
FIG. 6 is a front end view of the strain relief device of FIG. 5 in an open configuration according to one embodiment.
Figure 7:
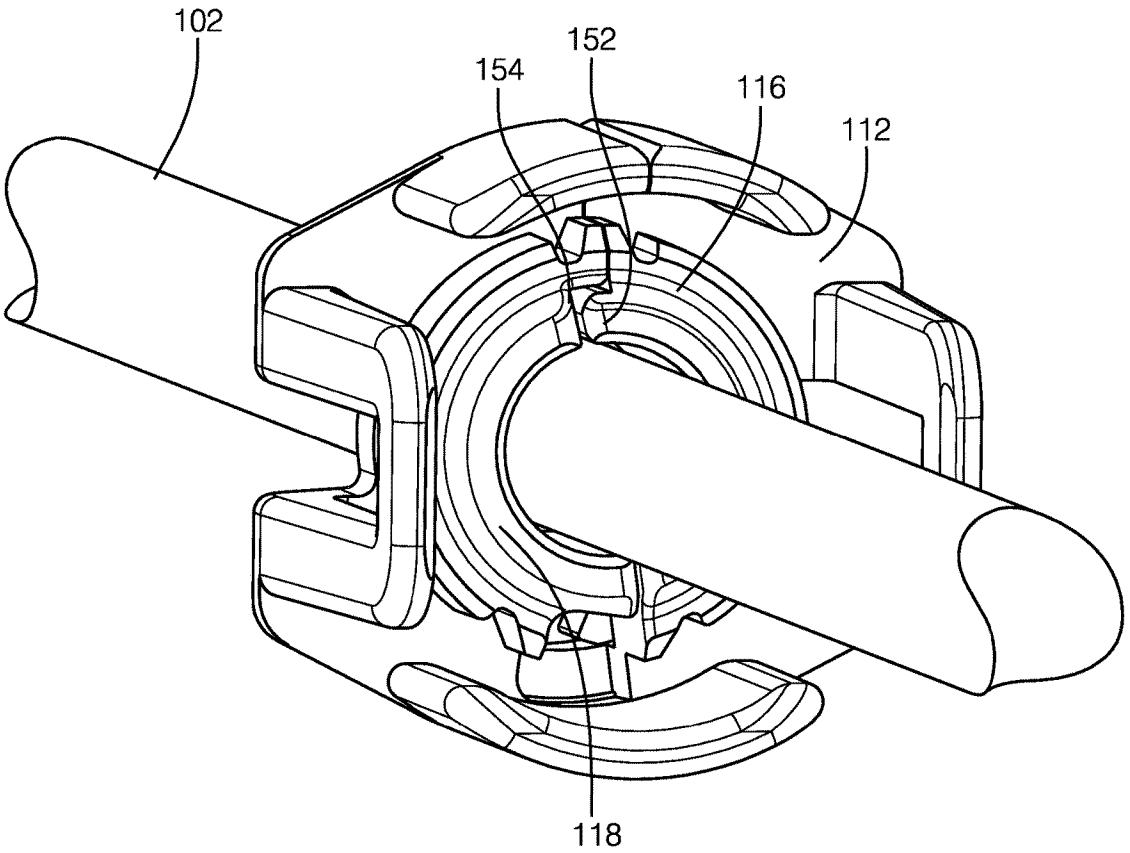
FIG. 7 is a front end view of the strain relief device of FIG. 5 in an closed configuration around the conductor according to one embodiment.
Figure 8:
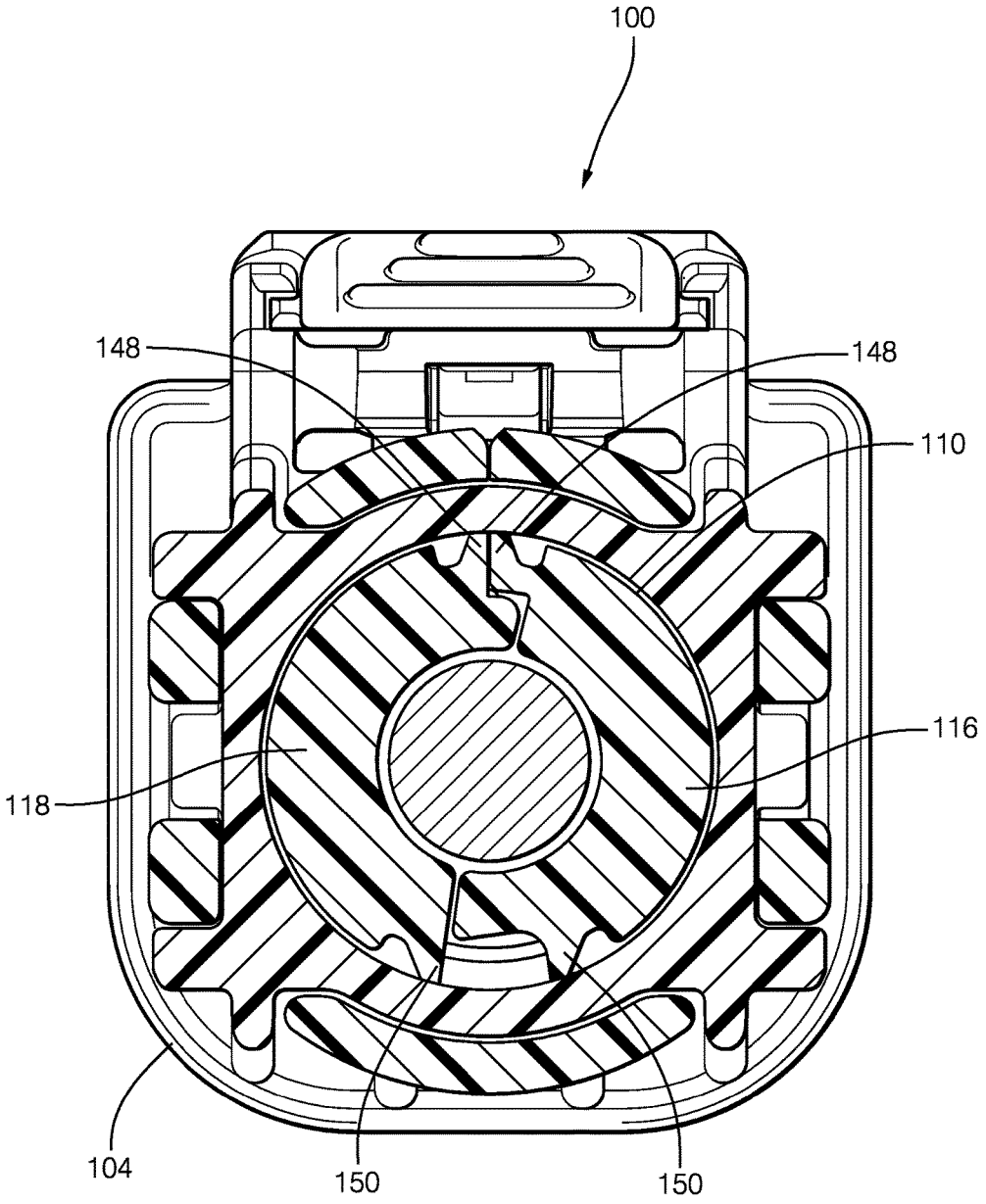
FIG. 8 is a cutaway side perspective view of the connector system of FIG. 1 according to one embodiment.

The assembly 100 further includes a strain relief device 112 having a clamping collar 114 that is configured to surround a portion of the cable. The strain relief device 112 is also formed of a polymeric material. The clamping collar 114 has a first half ring 116 and a second half ring 118. The first and second half rings 116, 118 each define a semicircular section configured to closely fit about the cable when the strain relief device 112 is closed about the cable as shown in FIG. 4. The first and second half rings 116, 118 each have first ends 120 that are separable from one another allowing the strain relief device 112 to be laterally placed over the cable as shown in FIG. 1. The first and second half rings 116, 118 also have second ends 122 that are joined by an arcuate shaped integrally formed flexible hinge feature, hereinafter referred to as the hinge 124. The clamping collar 114 further includes a rotation limiting feature 126 that is configured to limit an angle of rotation of the first half ring 116 and the second half ring 118 about the hinge 124. The rotation limiting feature 126 has a first arm 128 integrally formed with and extending from the first half ring 116 and an L-shaped second arm 130 integrally formed with and extending from the second half ring 118. The first and second arms 128, 130 each have a shape that may be characterized as having an L-shape or a J-shape. As best shown in FIG. 5, the free end of the first arm 128 is configured to contact and engage the free end of the second arm 130, thereby limiting the angle of rotation of the first and second half rings 116, 118 about the hinge 124. According to this embodiment, the first and second arms 128, 130 are disposed inboard of the hinge 124 and so are arranged intermediate the hinge 124 and the clamping collar 114. The rotation limiting feature 126 limits the maximum angle of rotation of the first and second arms 128, 130 about the hinge 124 to between 15 and 45 degrees as the first ends 120 are moved from a closed position 132 where both first ends 120 are in contact or near contact as shown in FIG. 4 to an open position 134 where both first ends 120 are separated as shown in FIG. 1.

Figure 2:
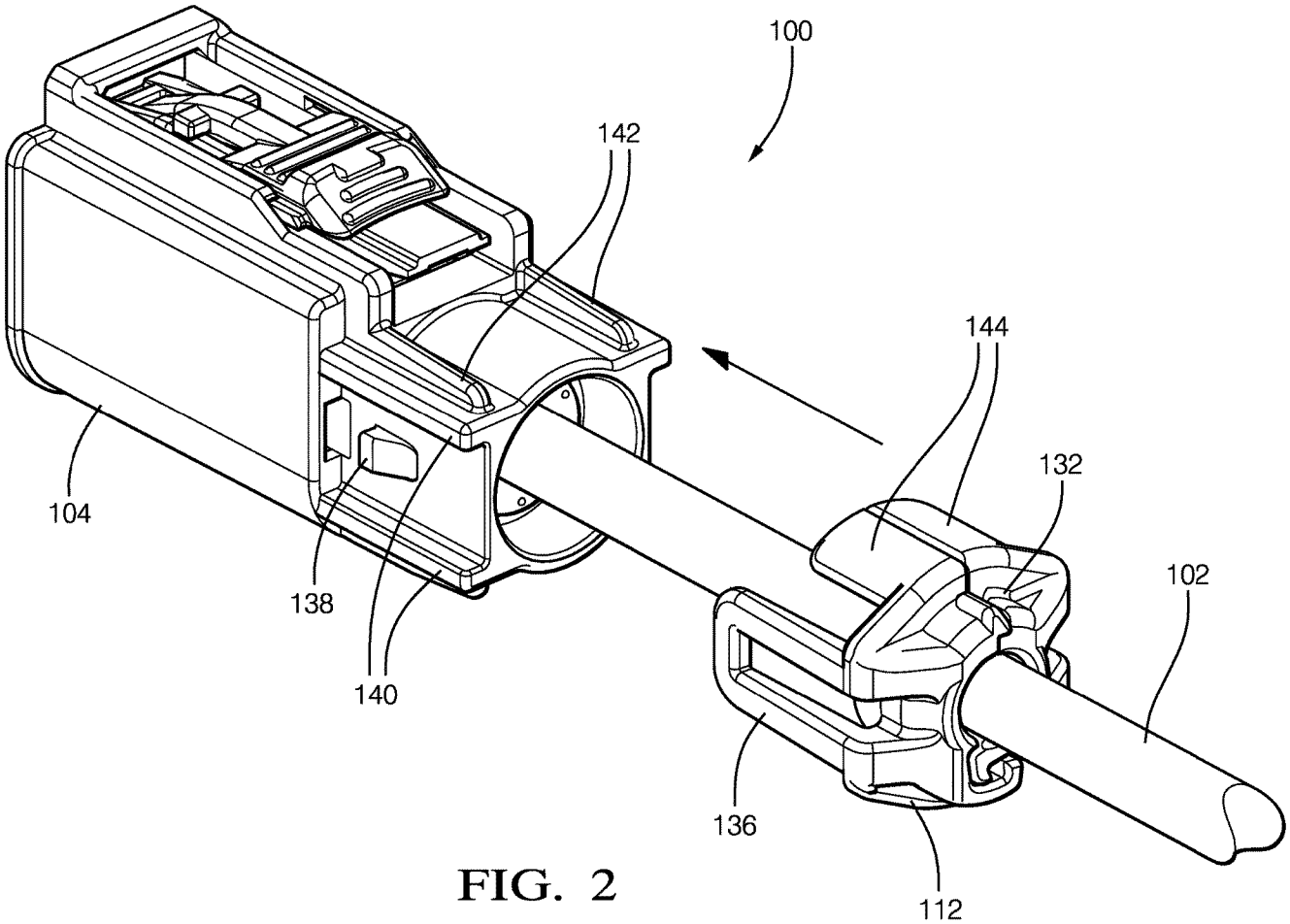
FIG. 2 is a perspective view of the connector system of FIG. 1 having a strain relief device installed over a conductor according to one embodiment.
Figure 3:
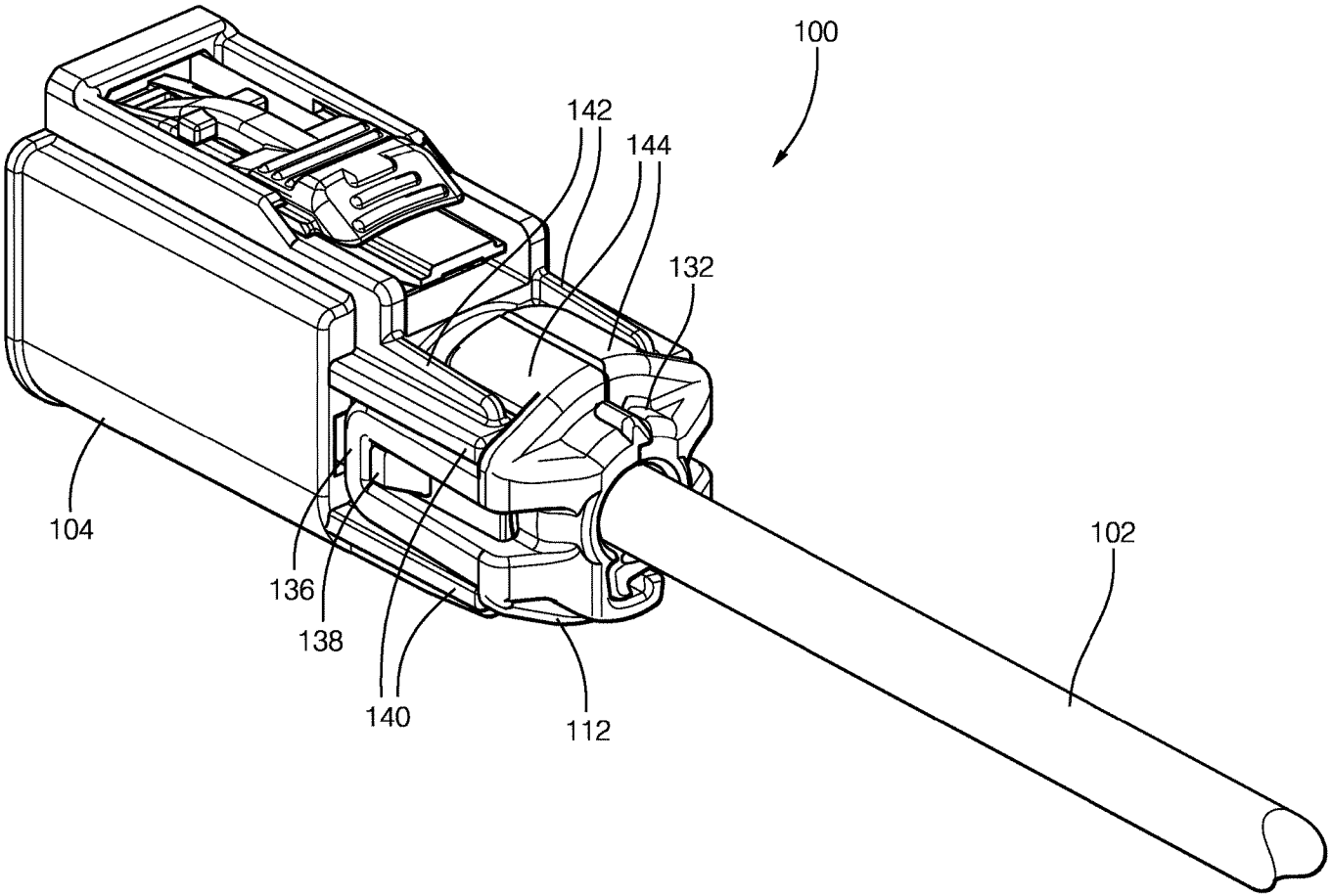
FIG. 3 is a perspective view of the connector system of FIG. 1 having the strain relief device connected to a connector body according to one embodiment.

As illustrated in FIGS. 2 and 3, the strain relief device is slid along the cable until the strain relief device 112 is secured to the connector body 104 by a pair of U-shaped arms 136 projecting from the strain relief device 112 that snap over teeth 138 defined by the connector body 104. These teeth 138 are flanked by elongated ridges 140 that extend parallel to a longitudinal axis X of the connector body 104. The ridges 140 are configured to guide the U-shaped arms 136 over the teeth 138 and inhibit rotation of the U-shaped arms 136 about the connector body 104.

The connector body 104 also defines a pair of ribs 142 that extend generally parallel to the longitudinal axis X. As used herein, generally parallel means ±10° from absolutely parallel. The first ends 120 of the first and second half rings 116, 118 each define an elongate tongue 144 that extends generally parallel the longitudinal axis X. Each of the tongues 144 of the first and second half rings 116, 118 are disposed between the pair of ribs 142 when the strain relief device 112 is connected to the connector body 104, thereby inhibiting rotation of the first and second half rings 116, 118 about the hinge 124 and keeping the strain relief device 112 is the closed position 132.

The first ends 120 of the first and second half rings 116, 118 each define a first radial projection 148 and the second ends 122 each define a second radial projection 150. The first and second radial projections are each in compressive contact with the inner wall 110 of the cavity 106 when the strain relief device 112 is connected to the connector body 104, thereby inhibiting rotation of the first and second half rings 116, 118 about the hinge 124.

The strain relief device 112 is configured to contact an end of the seal 108, thereby securing the seal 108 within the cavity 106.

The first end of the first half ring 116 defines a two lateral projections 152 extending generally perpendicular to the longitudinal axis X and the first end of the second half ring 118 defines two lateral indentations 154 also extending generally perpendicular to the longitudinal axis X. As used herein, generally perpendicular means ±10° from absolutely perpendicular. Each lateral projection 152 of the first half ring 116 is received within a corresponding lateral indentation 154 of the second half ring when the strain relief device 112 is connected to the connector body 104, thereby inhibiting motion of the first end of the first half ring 116 relative to the first end of the second half ring 118.

Figure 9:
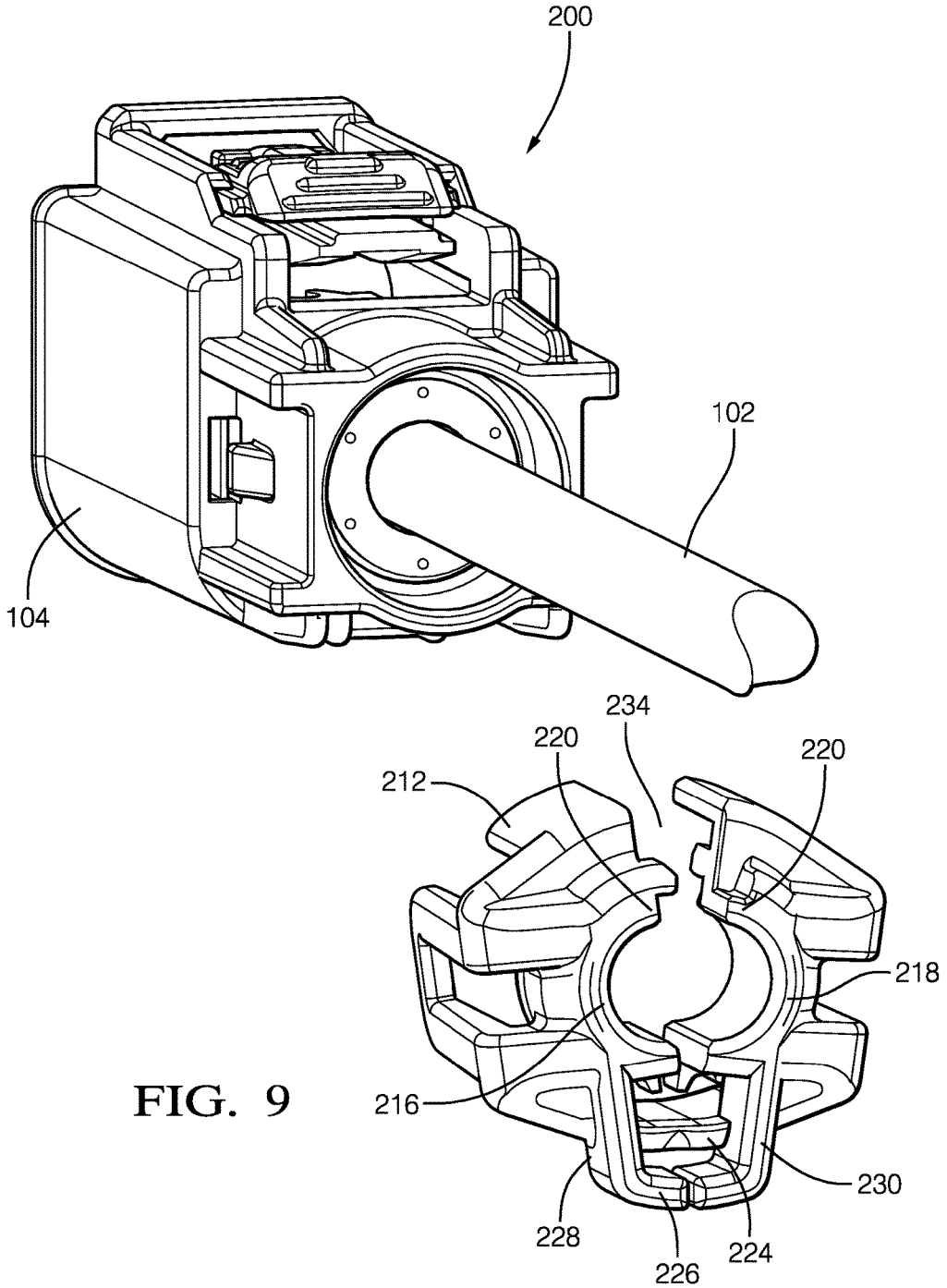
FIG. 9 is an exploded perspective view of a connector assembly according to another embodiment.
Figure 10:
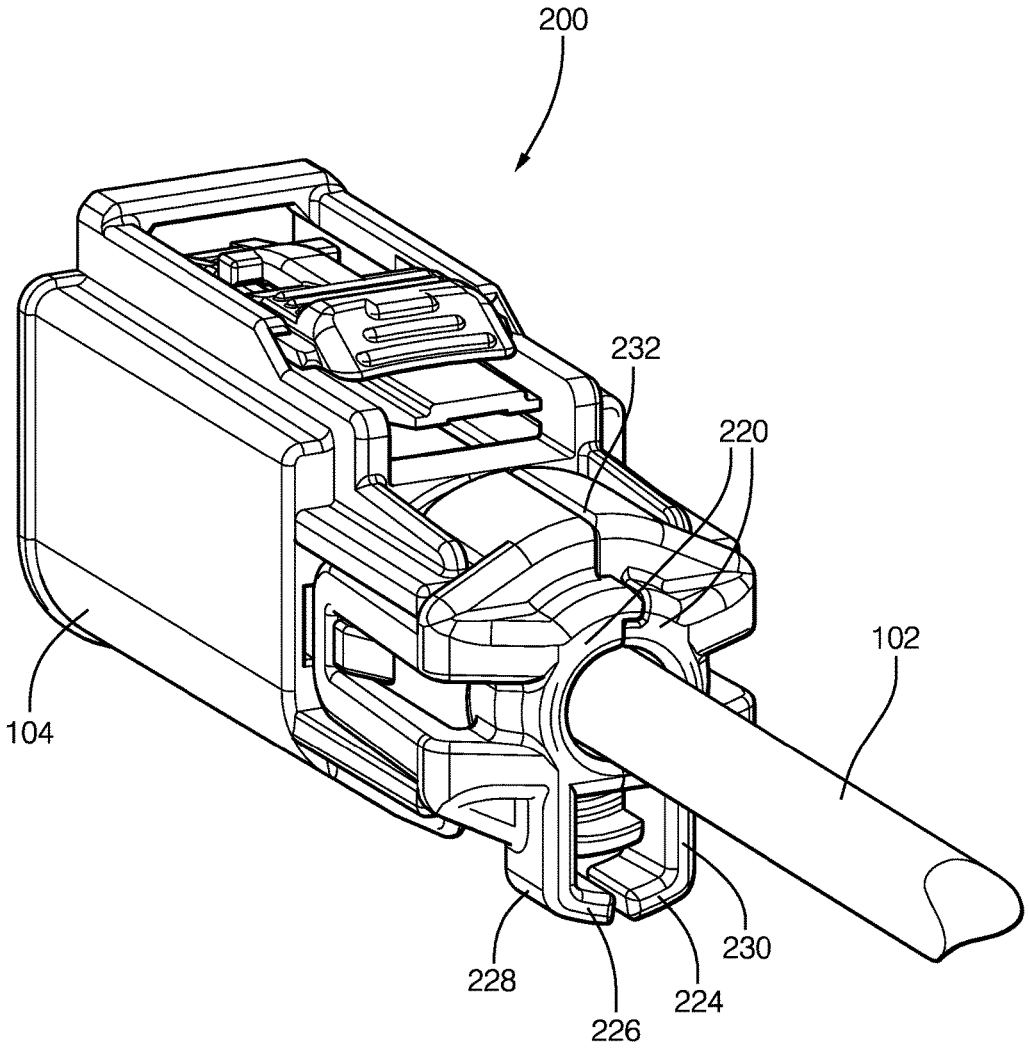
FIG. 10 is a perspective view of the connector system of FIG. 9 having the strain relief device connected to a connector body according to the other embodiment.

FIGS. 9 and 10 illustrate a second non-limiting example of a second embodiment of the invention. The connector assembly 200 is similar in construction to the connector assembly 100 with the exception of the rotation limiting feature 226 of the strain relief device 212. The rotation limiting feature 226 has an L-shaped first arm 228 that is integrally formed with and extends outwardly from the first half ring 216 and an L-shaped second arm 230 that is integrally formed with and extends outwardly from the second half ring 218. The first arm 228 is configured to contact the second arm 230, thereby limiting the angle of rotation of the first and second half rings 216, 218 about the hinge 224. According to this embodiment, the first and second arms 228, 230 are disposed outboard of the hinge 224 and so the hinge 224 is arranged intermediate the rotation limiting feature 226 and the cable. The rotation limiting feature 226 limits the maximum angle of rotation of the first and second arms 228, 230 about the hinge 224 to between 15 and 45 degrees as the first ends 220 are moved from a closed position 232 where both first ends 220 are in contact or near contact as shown in FIG. 10 to an open position 234 where both first ends 120 are separated as shown in FIG. 9.

Accordingly, a connector assembly is provided. The connector assembly includes a strain relief device that is hinged to allow it to be laterally assembled to the cable and be closed so that it fully surrounds the cable when it is attached to the connector body. The strain relief device includes a rotation limiting feature that inhibits over-rotation of the first and second arms that could damage the hinge between them. The strain relief device also includes radial projections that inhibit rotation of the first and second half rings about the hinge when the strain relief device is connected to the connector body. The strain relief device further includes lateral projections and lateral indentations that cooperate to limit axial movements of the ends of the first and second half rings of the clamping collar relative to one another.

The example presented herein is directed to an connector assembly for electrical cables, however other embodiments may be envisioned that are adapted for use with optical cables or with hybrid connector assemblies including both electrical and optical cables. Yet other embodiments of the connector assembly may be envisioned that are configured to interconnect pneumatic or hydraulic lines.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A connector assembly, comprising:

a connector body;

a flexible elongate conductor having one end terminated within the connector body; and a strain relief device attached to the connector body having a clamping collar configured to surround a portion of the conductor, wherein the clamping collar comprises a first half ring and a second half ring each having first ends that are separable from one another and each having second ends that are joined by a hinge feature, wherein the clamping collar further includes a rotation limiting feature configured to limit an angle of rotation of the first half ring and the second half ring about the hinge feature, wherein the rotation limiting feature comprises a first arm extending from the first half ring and a second arm extending from the second half ring and wherein the first arm is configured to contact the second arm, thereby limiting the angle of rotation.

2. The connector assembly according to claim 1, wherein the first and second arms are each characterized as having an L-shape.

3. The connector assembly according to claim 2, wherein the first and second arms are disposed intermediate the hinge feature and the conductor.

4. The connector assembly according to claim 2, wherein the hinge feature is disposed intermediate the first and second arms and the conductor.

5. A connector assembly, comprising:

a connector body;

a flexible elongate conductor having one end terminated within the connector body; and a strain relief device attached to the connector body having a clamping collar configured to surround a portion of the conductor, wherein the clamping collar comprises a first half ring and a second half ring each having first ends that are separable from one another and each having second ends that are joined by a hinge feature, wherein the clamping collar further includes a rotation limiting feature configured to limit an angle of rotation of the first half ring and the second half ring about the hinge feature, wherein a maximum angle of rotation is limited to between 15 and 45 degrees.

6. The connector assembly according to claim 5, wherein the connector body defines a cavity in which the conductor is received, wherein the first ends each define a first radial projection and the second ends each define a second radial projection, and wherein the first and second radial projections are each in compressive contact with an inner wall of the cavity, thereby inhibiting rotation of the first and second half rings about the hinge feature.

7. The connector assembly according to claim 6, wherein the connector assembly further comprises a compliant seal disposed within the cavity intermediate the conductor and the inner wall and wherein the strain relief device is configured to secure the seal within the cavity.

8. The connector assembly according to claim 5, wherein the first end of the first half ring defines a first lateral projection and the first end of the second half ring defines a second lateral projection, wherein the first end of the first half ring defines a first lateral indentation and the first end of the second half ring defines a second lateral indentation, and wherein the first lateral projection is received within the second lateral indentation and the second lateral projection is received within the first lateral indentation when the strain relief device is connected to the connector body, thereby inhibiting motion of the first end of the first half ring relative to the first end of the second half ring.

9. The connector assembly according to claim 5, wherein the conductor is an insulated wire cable.

10. A connector assembly, comprising:

a connector body;

a flexible elongate conductor having one end terminated within the connector body; and a strain relief device attached to the connector body having a clamping collar configured to surround a portion of the conductor, wherein the clamping collar comprises a first half ring and a second half ring each having first ends that are separable from one another and each having second ends that are joined by a hinge feature, wherein the clamping collar further includes a rotation limiting feature configured to limit an angle of rotation of the first half ring and the second half ring about the hinge feature, wherein the connector body defines a pair of ribs extending generally parallel to a longitudinal axis of the connector body, wherein the first ends of the first and second half rings each define a tongue extending generally parallel the longitudinal axis, and wherein the tongues are disposed between the pair of ribs when the strain relief device is connected to the connector body, thereby inhibiting rotation of the first and second half rings about the hinge feature.

11. A connector assembly, comprising:

a connector body;

a flexible elongate conductor having one end terminated within the connector body; and a strain relief device attached to the connector body having a clamping collar configured to surround a portion of the conductor, wherein the clamping collar comprises a first half ring and a second half ring each having first ends that are separable from one another and each having second ends that are joined by a hinge feature, wherein the clamping collar further includes means for limiting an angle of rotation of the first half ring and the second half ring about the hinge feature, wherein a maximum angle of rotation is limited to between 15 and 45 degrees.

12. A strain relief device configured to be attached to a connector body having a flexible insulated electrical cable terminated within, the strain relief device comprising:

a clamping collar configured to surround a portion of the electrical cable, wherein the clamping collar comprises a first half ring and a second half ring each having first ends that are separable from one another and each having second ends that are joined by a hinge feature, wherein the clamping collar further includes a rotation limiting feature configured to limit an angle of rotation of the first half ring and the second half ring about the hinge feature, wherein the rotation limiting feature comprises a first arm extending from the first half ring and a second arm extending from the second half ring and wherein the first arm is configured to contact the second arm, thereby limiting the angle of rotation.

13. The strain relief device according to claim 12, wherein the first and second arms are each characterized as having an L-shape.

14. The strain relief device according to claim 13, wherein the first and second arms are disposed inboard of the hinge feature.

15. The strain relief device according to claim 13, wherein the first and second arms are disposed outboard of the hinge feature.

16. A strain relief device configured to be attached to a connector body having a flexible insulated electrical cable terminated within, the strain relief device comprising:

a clamping collar configured to surround a portion of the electrical cable, wherein the clamping collar comprises a first half ring and a second half ring each having first ends that are separable from one another and each having second ends that are joined by a hinge feature, wherein the clamping collar further includes a rotation limiting feature configured to limit an angle of rotation of the first half ring and the second half ring about the hinge feature, wherein a maximum angle of rotation is limited to between 15 and 45 degrees.

* * * * *